US007284395B2

(12) United States Patent
Belanger

(10) Patent No.: US 7,284,395 B2
(45) Date of Patent: Oct. 23, 2007

(54) CRYOGENIC AIR SEPARATION PLANT WITH REDUCED LIQUID DRAIN LOSS

(75) Inventor: Paul William Belanger, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 378 days.

(21) Appl. No.: 10/932,285

(22) Filed: Sep. 2, 2004

(65) Prior Publication Data

US 2007/0199345 A1 Aug. 30, 2007

(51) Int. Cl.
*F25J 3/00* (2006.01)

(52) U.S. Cl. ..... 62/656; 62/653; 62/924; 62/643

(58) Field of Classification Search ..... 62/643, 62/653, 656, 924
See application file for complete search history.

(56) References Cited

U.S. PATENT DOCUMENTS 5,402,647 A * 4/1995 Bonaquist et al. ..... 62/651
5,505,051 A 4/1996 Darredeau et al. ..... 62/21
5,666,825 A 9/1997 Darredeau et al. ..... 62/656
5,918,482 A * 7/1999 Potempa ..... 62/646
6,006,546 A 12/1999 Espie ..... 62/656
6,070,433 A 6/2000 Smith, IV et al. ..... 62/648
6,073,462 A * 6/2000 Wong et al. ..... 62/654
6,257,019 B1 * 7/2001 Oakey et al. ..... 62/646
6,272,884 B1 * 8/2001 Billingham et al. ..... 62/656
2001/0054298 A1 * 12/2001 Rottmann et al. ..... 62/643
2002/0189281 A1 * 12/2002 Pompl ..... 62/646
2004/0000166 A1 * 1/2004 Moeller et al. ..... 62/643

* cited by examiner

*Primary Examiner*—William C Doerrler
(74) *Attorney, Agent, or Firm*—David M. Rosenblum

(57) ABSTRACT

A cryogenic air separation plant and method of operation wherein, after an interruption in operation, liquid from the sump of a lower pressure column and liquid from the sump of a higher pressure column is passed to a condenser, preferably an argon column top condenser, prior to the restarting of the plant.

10 Claims, 1 Drawing Sheet

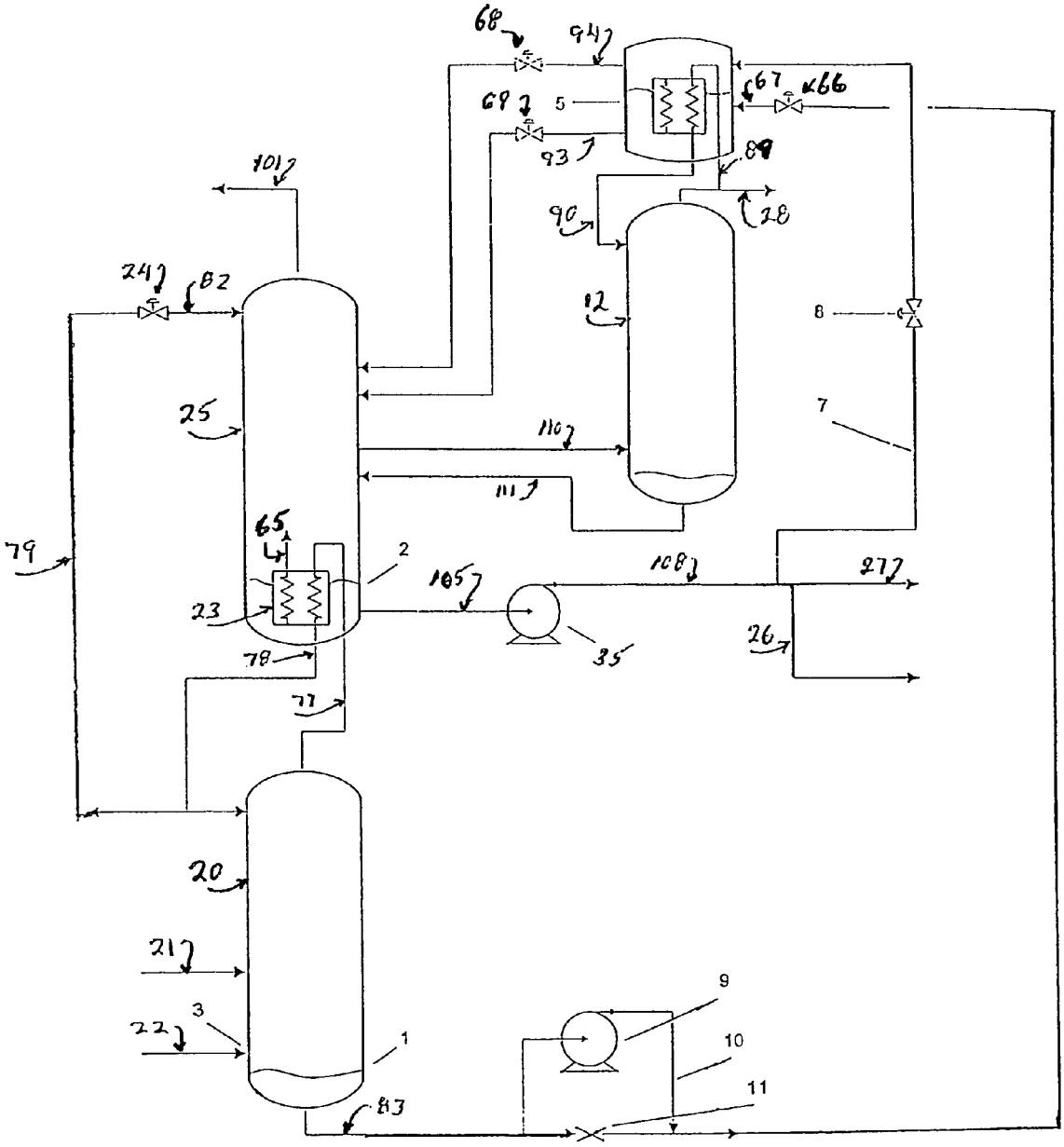
68
94
67
66
69
5
93
89
101
90
28
24
82
12
8
25
110
7
111
65
79
2
105
108
27
23
35
26
78
77
20
21
9
22
3
1
10
11
83

CRYOGENIC AIR SEPARATION PLANT WITH REDUCED LIQUID DRAIN LOSS

TECHNICAL FIELD

This invention relates generally to cryogenic air separation and, more particularly, to cryogenic air separation employing a double column especially with an associated argon column.

BACKGROUND ART

The separation of air by cryogenic rectification is an energy intensive process, particularly for the generation of the refrigeration required to drive the separation. Accordingly it is desirable to keep refrigeration losses to a minimum. One potential source of refrigeration loss is the draining of liquid from one or more of the columns upon plant shut down. Moreover draining of liquid results in loss of accumulated argon which would take a substantial amount of time to replace once the plant returns to operation. Accordingly it is an object of this invention to provide a cryogenic air separation plant which can reduce liquid drain losses and the consequent refrigeration and argon loss with that liquid.

SUMMARY OF THE INVENTION

The above and other objects, which will become apparent to those skilled in the art upon a reading of this disclosure, are attained by the present invention one aspect of which is:

A cryogenic air separation plant comprising a lower pressure column, a higher pressure column, and at least one condenser, means for passing liquid from the bottom of the lower pressure column to said condenser, and means for passing liquid from the bottom of the higher pressure column to said condenser.

Another aspect of the invention is:

A method for restarting a cryogenic air separation plant after an interruption in operation, said cryogenic air separation plant comprising a lower pressure column, a higher pressure column, and a condenser, comprising passing liquid from the bottom of the lower pressure column to the condenser, passing liquid from the bottom of the higher pressure column to the condenser, and restarting the cryogenic air separation plant.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein the term, "bottom" when referring to a column means the sump, i.e. that section of the column below the column mass transfer internals such as trays or packing.

As used herein the term "condenser" means a heat exchange device wherein during operation at least one of the heat exchange fluids undergoes a phase change.

As used herein the term, "top condenser" means a heat exchange device that generates column downflow liquid from column vapor.

BRIEF DESCRIPTION OF THE DRAWING

The sole FIGURE is a simplified schematic representation of one particularly preferred embodiment of the cryogenic air separation plant of this invention.

DETAILED DESCRIPTION

In the practice of this invention, after an interruption in the operation of a double column of a cryogenic air separation plant, liquid from the bottom of the lower pressure column and also from the bottom of the higher pressure column is passed to a condenser prior to the restarting of the column. The liquid from either or both of the columns may be passed to the condenser using available pressure energy from within the plant. The liquid from either or both of the columns may also be passed to the condenser using a liquid pump. Preferably the cryogenic air separation plant comprises an argon column having a top condenser and liquid from the bottom of both the lower pressure column and the high pressure column is passed to the argon column top condenser. Liquid from the bottom of the lower pressure column and/or the higher pressure column may be passed to another condenser of the cryogenic air separation plant such as a product boiler.

The invention will be described in greater detail with reference to the Drawing. In the FIGURE there is illustrated a cryogenic air separation plant having three columns, a double column having higher and lower pressure columns, and an argon sidearm column having a top condenser.

Feed air is passed into higher pressure column 20 in liquid air stream 21 and vapor air stream 22. Higher pressure column 20 is operating at a pressure generally within the range of from 35 to 250 pounds per square inch absolute (psia).

Within higher pressure column 20 the feed air is separated by cryogenic rectification into nitrogen-enriched vapor and oxygen-enriched liquid. Nitrogen-enriched vapor is withdrawn from the upper portion of higher pressure column 20 in stream 77 and condensed in reboiler 23 by indirect heat exchange with boiling lower pressure column bottom liquid to produce column upflow vapor 65. Resulting nitrogen-enriched liquid 78 is returned to column 20 as reflux. A portion of the nitrogen-enriched liquid 79 is passed from column 20 to valve 24 and then passed in stream 82 into lower pressure column 25 as reflux.

Oxygen-enriched liquid is withdrawn from the lower portion of higher pressure column 20 in stream 83 and passed through valve 66 and as stream 67 into argon column top condenser 5 wherein it is partially vaporized. The resulting vapor is withdrawn from condenser 5 in stream 94 and passed through valve 68 and into lower pressure column 25. Remaining oxygen-enriched liquid is withdrawn from condenser 5 in stream 93 and then passed through valve 69 and into lower pressure column 25.

Lower pressure column 25 is operating at a pressure less than that of higher pressure column 20 and generally within the range of from 15 to 100 psia. Within lower pressure column 25 the various feeds are separated by cryogenic rectification into nitrogen-enriched vapor and oxygen-enriched liquid. Nitrogen-enriched vapor is withdrawn from the upper portion of column 25 in stream 101 and recovered as product nitrogen having a nitrogen concentration of at least 99 mole percent. Oxygen-enriched liquid is withdrawn from the lower portion of column 25 in stream 105 having an oxygen concentration generally within the range of from 90 to 99.9 mole percent. In the embodiment of the invention illustrated in the FIGURE, stream 105 is pumped to a higher pressure by passage through first liquid pump 35 and resulting pressurized stream 108 is recovered as product as liquid in stream 26 and/or as vapor in stream 27 which is first processed in a product boiler (not shown).

Fluid comprising oxygen and argon is passed in stream 110 from lower pressure column 25 into argon column 12 wherein it is separated by cryogenic rectification into argon-richer fluid and oxygen-richer fluid. Oxygen-richer fluid is passed from the lower portion of column 12 in stream 111 into lower pressure column 25. Argon-richer fluid is passed from the upper portion of column 12 in vapor stream 89 into argon column top condenser 5 wherein it is condensed by indirect heat exchange with the aforesaid partially vaporizing oxygen-enriched liquid. Resulting argon-richer liquid is withdrawn from top condenser 5 in stream 90 and passed into argon column 12 as reflux. A portion of stream 89, shown in the FIGURE as stream 28 and/or a portion of stream 90, not shown in the FIGURE, may be recovered as product argon having an argon concentration of at least 95 mole percent.

Upon process shut-down, all of the liquid within the columns will accumulate in the column sumps and to a certain extent some of the process piping. The liquid held up on the trays or packing of the higher pressure column will settle in the higher pressure column sump 1. The liquid held up on the trays or packing of the lower pressure column will accumulate in the lower pressure column sump 2. The liquid held up on the trays or packing of the argon column will drain into the lower pressure column and accumulate in the lower pressure column sump. If the separation performed in the argon column occurs in multiple column vessels, the liquid held up on the packing of the columns will accumulate in the sumps. Typically the sumps in the columns are sized fairly small to avoid extra capital expense and additional heat losses that would occur as a result of increased equipment surface area. As a result, the sumps tend to completely fill and sometimes over-fill after a shut-down. This creates some problems for the plant operators when they need to start the equipment back up. If the higher pressure column sump level is too high it can encroach upon the vapor air inlet nozzle 3, which would result in lifting of trays or packing in the lower column if the air were introduced under these circumstances. Also if the liquid level in the lower pressure column sump exceeds a certain level the plant cannot be restarted.

Accordingly there are times when liquid must be drained from the lower pressure and higher pressure column sumps prior to start-up. This is wasteful for two reasons: 1) there is a substantial amount of refrigeration stored in the liquid, and 2) the liquid will tend to be rich in argon and oxygen. For these reasons whenever liquid is drained from the plant it necessarily causes an increase in plant start-up time and/or excessive use of liquid assistance during the start-up.

In the practice of the invention liquid is transferred from the bottom or sump of each of the lower pressure and higher pressure columns to a condenser prior to start-up after a plant shut down. Preferably liquid from both the lower pressure and higher pressure column sumps is passed to the argon column top condenser. The liquid may be passed to a condenser using available pressure energy or liquid from one or both of the lower pressure and higher pressure column sumps may be passed to a condenser using a liquid pump.

Referring back now to the embodiment of the invention illustrated in the FIGURE, since the first liquid pump 35 is started prior to the introduction of feed air to the columns, the driving force to move liquid from the lower pressure column sump to the argon column condenser is available. What is needed is a transfer line 7 and a valve 8. The addition of this line enables the transfer liquid from the lower pressure column sump to the argon column condenser instead of draining the liquid.

Due to the elevation between the higher pressure column and the argon column condenser a second liquid pump 9 is preferably used to transfer liquid prior to restart. Shown in the FIGURE is pump 9, a section of piping 10, and a check valve 11. The second liquid pump 9 is turned on to transfer liquid through line 83, valve 66 and line 67 from the higher pressure column to the argon column condenser prior to system start-up. The check valve on the main transfer line ensures that none of the liquid is recirculated through the pump. Generally during normal operation second liquid pump 9 is not in operation because it is not needed since the higher pressure column is of sufficient pressure to transfer liquid from the sump or bottom of the higher pressure column to the argon column top condenser.

The cryogenic air separation plant of this invention provides several advantages over conventional arrangements. One advantage is that since no extra liquid storage capacity is needed there is minimal space required inside the cold-box to implement the system. This means that for new systems the cold-box can remain the same size. For existing plants the invention can be implemented without moving equipment. A second advantage is because all of the liquid is moved prior to the start-up, there is no need for an elaborate control system to coordinate the moving of the liquid with the normal start-up of the plant. Some control systems can be fairly complex. Additional control complexity adds to the effort required to commission a system and also reduces the probability of achieving success. Another advantage is that since the liquid is collected where it ordinarily winds up anyway, there is no need to introduce any special collectors to the column internals or increase the size of the argon column sump. Because all of the liquid in the practice of the invention is moved prior to start-up (as opposed to continuous re-circulation) the required liquid flow rates will be smaller. This means that smaller pumps, valves, and process lines can be used. A further advantage of the invention is that it is not limited to just speeding up the time required to start-up the argon column. The time required to reach product purities for all products is reduced.

Although the invention has been described in detail with reference to a certain particularly preferred embodiment, those skilled in the art will recognize that there are other embodiments of the invention within the spirit and the scope of the claims.

The invention claimed is:

1. A cryogenic air separation plant comprising a lower pressure column, a higher pressure column, and at least one condenser, each of the lower pressure column and the higher pressure column having a sump located at the bottom thereof, means for passing liquid from the sump located at the bottom of the lower pressure column to said condenser, and means for passing liquid from the sump located at the bottom of the higher pressure column to said condenser.

2. The cryogenic air separation plant of claim 1 wherein the condenser is a top condenser of an argon column.

3. The cryogenic air separation plant of claim 2 wherein the means for passing liquid from the sump located at the bottom of the lower pressure column passes liquid to the argon column top condenser, and the means for passing liquid from the bottom of the higher pressure column passes liquid to the argon column top condenser.

4. The cryogenic air separation plant of claim 1 wherein the means for passing liquid from the sump located at the bottom of the lower pressure column to the condenser comprises a liquid pump.

5. The cryogenic air separation plant of claim 1 wherein the means for passing liquid from the sump located at the bottom of the higher pressure column to the condenser comprises a liquid pump.

6. A method for restarting a cryogenic air separation plant after an interruption in operation, said cryogenic air separation plant comprising a lower pressure column, a higher pressure column, and a condenser, each of the lower pressure column and the higher pressure column having a sump located at the bottom thereof, said method comprising passing liquid from the sump located at the bottom of the lower pressure column to the condenser, passing liquid from the sump located at the bottom of the higher pressure column to the condenser, and restarting the cryogenic air separation plant.

7. The method of claim 6 wherein the cryogenic air separation plant further comprises an argon column with a top condenser, and liquid from the sump located at the bottom of the lower pressure column is passed to the argon column top condenser.

8. The method of claim 6 wherein the cryogenic air separation plant further comprises an argon column with a top condenser, and liquid from the sump located at the bottom of the higher pressure column is passed to the argon column top condenser.

9. The method of claim 6 further comprising recovering nitrogen product from the lower pressure column.

10. The method of claim 6 further comprising recovering oxygen product from the lower pressure column.

* * * * *